US011175601B2

(12) United States Patent
Sakamoto

(10) Patent No.: US 11,175,601 B2
(45) Date of Patent: Nov. 16, 2021

(54) TONER

(71) Applicant: KYOCERA Document Solutions Inc., Osaka (JP)

(72) Inventor: Noriaki Sakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/101,342

(22) Filed: Nov. 23, 2020

(65) Prior Publication Data

US 2021/0157251 A1 May 27, 2021

(30) Foreign Application Priority Data

Nov. 27, 2019 (JP) ..... JP2019-214306

(51) Int. Cl.

| | |
|---|---|
| ***G03G 9/097*** | (2006.01) |
| ***G03G 9/093*** | (2006.01) |
| ***G03G 9/08*** | (2006.01) |
| ***G03G 9/087*** | (2006.01) |

(52) U.S. Cl.

CPC ..... *G03G 9/09791* (2013.01); *G03G 9/0819* (2013.01); *G03G 9/0827* (2013.01); *G03G 9/08711* (2013.01); *G03G 9/09335* (2013.01)

(58) Field of Classification Search

CPC ..... G03G 9/09708; G03G 9/09791

See application file for complete search history.

(56) References Cited

U.S. PATENT DOCUMENTS 6,160,142 A * 12/2000 Sawada ..... C07C 51/412 430/108.1
2013/0122408 A1* 5/2013 Haruyama ..... G03G 5/14726 430/56
2014/0295333 A1* 10/2014 Klenkler ..... G03G 9/09733 430/56
2016/0246197 A1* 8/2016 Matsushita ..... G03G 9/0819

FOREIGN PATENT DOCUMENTS

JP 2007-147979 A 6/2007

* cited by examiner

*Primary Examiner* — Peter L Vajda
(74) *Attorney, Agent, or Firm* — Studebaker & Brackett PC

(57) ABSTRACT

A toner includes toner particles and zinc stearate particles. The toner particles each include a toner mother particle containing a binder resin. The zinc stearate particles have a 50% volume cumulative diameter of at least 3.0 μm and no greater than 6.0 μm. A presence ratio of the zinc stearate particles having a particle diameter of no greater than 1.0 μm is no greater than 2.0% by volume relative to a total amount of the zinc stearate particles. A presence ratio of the zinc stearate particles having a particle diameter of at least 10.0 μm is no greater than 2.0% by volume relative to the total amount of the zinc stearate particles.

6 Claims, 3 Drawing Sheets

TONER

INCORPORATION BY REFERENCE

The present application claims priority under 35 U.S.C. § 119 to Japanese Patent Application No. 2019-214306, filed on Nov. 27, 2019. The contents of this application are incorporated herein by reference in their entirety.

BACKGROUND

The present disclosure relates to a toner.

A known toner includes metallic soap particles (specific examples include zinc stearate particles) having a number average primary particle diameter of no greater than 1.5 μm as external additive particles.

SUMMARY

A toner according to the present disclosure includes toner particles and zinc stearate particles. The toner particles each include a toner mother particle containing a binder resin. The zinc stearate particles have a 50% volume cumulative diameter of at least 3.0 μm and no greater than 6.0 μm. A presence ratio of the zinc stearate particles having a particle diameter of no greater than 1.0 μm is no greater than 2.0% by volume relative to the total amount of the zinc stearate particles. A presence ratio of the zinc stearate particles having a particle diameter of at least 10.0 μm is no greater than 2.0% by volume relative to the total amount of the zinc stearate particles.

DETAILED DESCRIPTION

Figure 1:
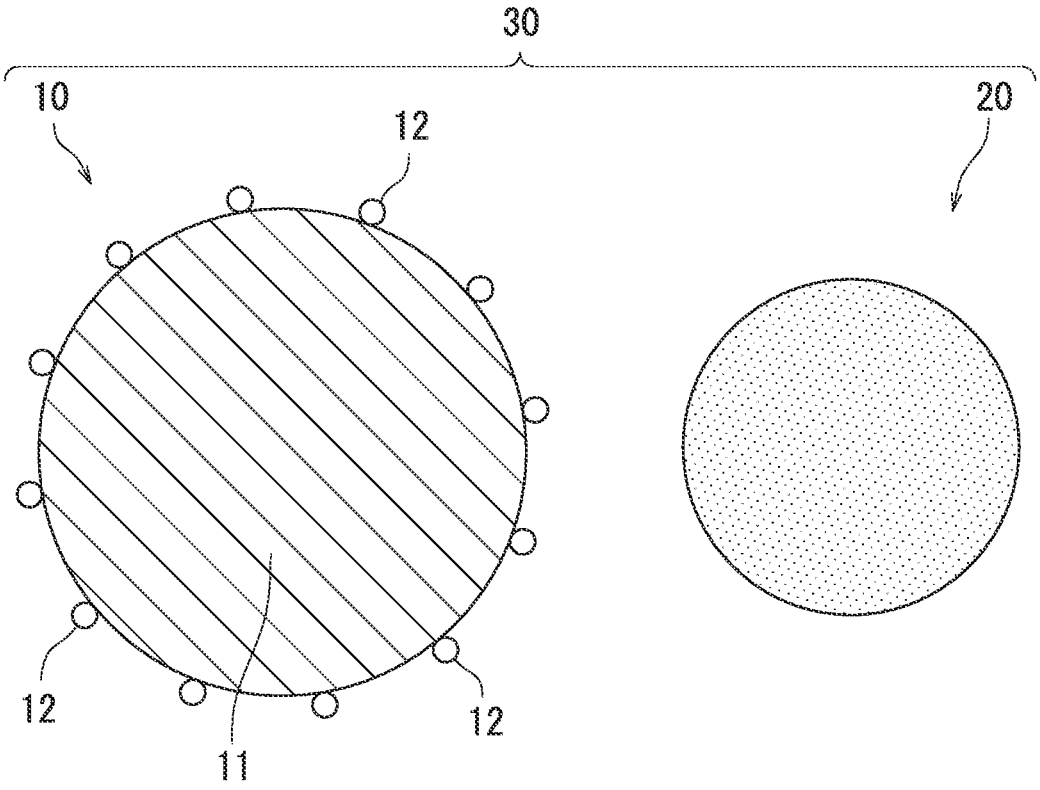
FIG. 1 is a diagram illustrating an example of a cross-sectional structure of each of a toner particle and a zinc stearate particle included in a toner according to an embodiment of the present disclosure.

The following describes a preferable embodiment of the present disclosure. Terms used in the present specification will be described first. A toner is a collection of toner particles and zinc stearate particles (for example, a powder mixture including a powder of toner particles and a powder of zinc stearate particles). An external additive is a collection (for example, a powder) of external additive particles. Unless otherwise stated, evaluation results (for example, values indicating shape and physical properties) for a powder (specific examples include a powder of toner particles, a powder of zinc stearate particles, and a powder of external additive particles) are each a number average of values measured for a suitable number of particles selected from the powder.

The "50% volume cumulative diameter" is a particle diameter at which the cumulative frequency from the small particle diameter side in a particle size distribution by volume (volume particle size distribution) is 50%.

A value for volume median diameter ($D_{50}$) of a powder is a median of diameter by volume (50% volume cumulative diameter) measured using a laser diffraction/scattering particle size distribution analyzer ("LA-950", product of Horiba, Ltd.) unless otherwise stated. A value for number average primary particle diameter of a powder is a number average of equivalent circle diameters of 100 primary particles (Heywood diameter: diameters of circles having the same areas as projected areas of the primary particles) measured using a scanning electron microscope ("JSM-7401F", product of JEOL Ltd.) and image analysis software ("WinROOF", product of MITANI CORPORATION) unless otherwise stated. Note that a number average primary particle diameter of particles refers to a number average primary particle diameter of particles of a powder (number average primary particle diameter of the powder) unless otherwise stated.

A level of chargeability refers to a level of susceptibility to triboelectric charging unless otherwise stated. A measurement target (for example, a toner) is triboelectrically charged for example by mixing and stirring the measurement target with a standard carrier (N-01: a standard carrier for a negatively chargeable toner, P-01: a standard carrier for a positively chargeable toner) provided by The Imaging Society of Japan. An amount of charge of the measurement target is measured before and after triboelectric charging using for example a compact draw-off charge measurement system ("MODEL 212HS", product of TREK, Inc.). A measurement target having a larger change in amount of charge between before and after the triboelectric charging has stronger chargeability.

A value for a softening point (Tm) is measured using a capillary rheometer ("CFT-500D", product of Shimadzu Corporation) unless otherwise stated. On an S-shaped curve (horizontal axis: temperature, vertical axis: stroke) plotted using the capillary rheometer, the softening point (Tm) is a temperature corresponding to a stroke value of "(base line stroke value+maximum stroke value)/2".

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

<Toner>

A toner according to the present embodiment is suitable for example for use as a positively chargeable toner in electrostatic latent image development. The toner may be used as a one-component developer. Alternatively, the toner may be mixed with a carrier using a mixer (for example, a ball mill) to prepare a two-component developer.

The toner according to the present embodiment includes toner particles each including a toner mother particle containing a binder resin. The toner according to the present embodiment includes zinc stearate particles having a 50% volume cumulative diameter of at least 3.0 μm and no greater than 6.0 μm. In the toner according to the present embodiment, a presence ratio of zinc stearate particles having a particle diameter of no greater than 1.0 μm is no greater than 2.0% by volume relative to the total amount of the zinc stearate particles. In the toner according to the present embodiment, a presence ratio of zinc stearate particles having a particle diameter of at least 10.0 μm is no greater than 2.0% by volume relative to the total amount of the zinc stearate particles.

The 50% volume cumulative diameter (unit: μm) of the zinc stearate particles may be referred to below as a $StD_{50}$. The presence (volume) ratio (unit:% by volume) of the zinc stearate particles having a particle diameter of no greater than 1.0 μm relative to the total amount of the zinc stearate particles may be referred to below as a $StR_{D\leq1}$. The presence ratio (unit:% by volume) of the zinc stearate particles having a particle diameter of at least 10.0 μm relative to the total amount of the zinc stearate particles may be referred to below as a $StR_{D\geq10}$. The $StD_{50}$, $StR_{D\leq1}$, and $StR_{D\geq10}$ are all measured by the same method as that described below in association with Examples or a method conforming therewith using the laser diffraction/scattering particle size distribution analyzer.

As a result of the toner according to the present embodiment having the above-described features, occurrence of fogging can be inhibited while inhibiting occurrence of image deletion. The reasons are presumed as follows.

The toner according to the present embodiment has a $StD_{50}$ of at least 3.0 μm. As a result, adhesion of the zinc stearate particles to the toner particles tends to be poor. As a result, when the toner according to the present embodiment is used in a developing process, the zinc stearate particles are relatively easy to adhere to the surface of an image bearing member (for example, a photosensitive drum). Zinc stearate particles each have a hydrophobic group ($-C_{17}H_{35}$). As a result, the surface of the image bearing member to which the zinc stearate particles are attached is inhibited from absorbing moisture. Further, since the toner according to the present embodiment has a $StR_{D\leq1}$ of no greater than 2.0% by volume, it is possible to supply an image bearing member with a sufficient amount of zinc stearate particles for inhibiting moisture absorption on the surface of the image bearing member. Accordingly, with use of the toner according to the present embodiment, occurrence of image deletion due to moisture absorption by the surface of an image bearing member can be inhibited.

On the other hand, zinc stearate particles having a relatively large particle diameter tend to remain in a developing device without being supplied to the image bearing member in the developing process. In particular, when zinc stearate particles having a relatively large particle diameter are present at a high presence ratio (volume ratio relative to the total amount of the zinc stearate particles), the amount of zinc stearate particles having a relatively large particle diameter remaining in the developing device tends to increase. When zinc stearate particles having a relatively large particle diameter remain in the developing device, an amount of charge of the toner particles may vary in the development device. As a result of the amount of charge of the toner particles varying, fogging is likely to occur in a formed image. By contrast, the toner according to the present embodiment has a $StD_{50}$ of no greater than 6.0 μm. Further, the toner according to the present embodiment has a $StR_{D\geq10}$ of no greater than 2.0% by volume. As described above, the $StD_{50}$ and the $StR_{D\geq10}$ of the toner according to the present embodiment each have an upper limit set so as to inhibit zinc stearate particles from remaining in the developing device. Therefore, with use of the toner according to the present embodiment, occurrence of fogging can be inhibited.

In order to further inhibit occurrence of image deletion, the $StD_{50}$ in the present embodiment is preferably at least 4.0 μm, and more preferably at least 5.0 μm. Further, in order to further inhibit occurrence of fogging, the $StD_{50}$ in the present embodiment is preferably no greater than 3.5 μm, and more preferably no greater than 3.3 μm.

In order to further inhibit occurrence of image deletion, the amount of the zinc stearate particles in the present embodiment is preferably at least 0.02 parts by mass relative to 100 parts by mass of the toner mother particles, more preferably at least 0.10 parts by mass, and still more preferably at least 0.15 parts by mass. In order to further inhibit occurrence of fogging, the amount of the zinc stearate particles in the present embodiment is preferably no greater than 0.50 parts by mass relative to 100 parts by mass of the toner mother particles, more preferably no greater than 0.30 parts by mass, and still more preferably no greater than 0.25 parts by mass.

In order to reduce manufacturing cost of the toner of the present embodiment, the $StR_{D\leq1}$ is preferably at least 0.1% by volume, more preferably at least 0.4% by volume, and still more preferably at least 0.8% by volume. For the same reason, the $StR_{D\geq10}$ in the present embodiment is preferably at least 0.1% by volume, and more preferably at least 0.4% by volume.

The toner particles included in the toner according to the present embodiment may further include an external additive. When the toner particles further include an external additive, the toner particles each include a toner mother particle containing a binder resin, and an external additive attached to the surface of the toner mother particle. Note that the external additive may be omitted when not necessary. When the external additive is omitted, the toner mother particles correspond to the toner particles.

The toner particles included in the toner according to the present embodiment may be toner particles each including no shell layer or toner particles each including a shell layer (may be referred to below as capsule toner particles). In each capsule toner particle, the toner mother particle includes a toner core containing a binder resin, and a shell layer covering the surface of the toner core. The shell layer contains a resin. For example, when low-melting toner cores are covered with shell layers having high heat resistance, heat-resistant preservability and low-temperature fixability of the toner can be both achieved. An additive may be dispersed in the resin constituting the shell layer. The shell layer may cover the entire surface of the toner core or partially cover the surface of the toner core.

In the present embodiment, the toner mother particles may contain an internal additive (at least one of a colorant, a releasing agent, a charge control agent, and a magnetic powder, for example) in addition to the binder resin, if necessary.

The following describes the toner according to the present embodiment in detail with reference to the accompanying drawings. FIG. 1 to be referred to schematically illustrates elements of configuration in order to facilitate understanding. Properties such as size and shape, and the number of the elements of configuration illustrated in the drawings may differ from actual properties and the number thereof in order to facilitate preparation of the drawings.

[Structure of Toner]

The following describes a structure of the toner according to the present embodiment with reference to FIG. 1. FIG. 1 is a diagram illustrating an example of a cross-sectional structure of a toner particle and a zinc stearate particle included in the toner according to the present embodiment.

A toner 30 illustrated in FIG. 1 includes a powder of toner particles 10 and a powder of zinc stearate particles 20. The toner particles 10 each include a toner mother particle 11 containing a binder resin, and an external additive 12 attached to the surface of the toner mother particle 11. The zinc stearate particles 20 have a 50% volume cumulative diameter of at least 3.0 μm and no greater than 6.0 μm. A presence ratio of zinc stearate particles 20 having a particle diameter of no greater than 1.0 μm is no greater than 2.0% by volume relative to the total amount of the zinc stearate particles 20. A presence ratio of zinc stearate particles 20 having a particle diameter of at least 10.0 μm is no greater than 2.0% by volume relative to the total amount of the zinc stearate particles 20.

The zinc stearate particles 20 may or may not be attached to the surfaces of the toner mother particles 11.

In order to make the toner 30 suitable for image formation, the volume median diameter ($D_{50}$) of the toner mother particles 11 is preferably at least 4 μm and no greater than 9 μm.

An example of the structure of the toner according to the present embodiment has been described so far with reference to FIG. 1. However, the present disclosure is not limited thereto. For example, the toner particles included in the toner according to the present embodiment may include no external additive. However, in order to obtain a toner having excellent fluidity, it is preferable that the toner particles included in the toner according to the present disclosure include an external additive.

[Elements of Toner]

The following describes elements of the toner according to the present embodiment. Components contained in the toner particles will be described first.

{Toner Particles}

(Binder Resin)

The binder resin accounts for at least 70% by mass of all components of the toner mother particles, for example. Accordingly, properties of the binder resin are thought to have a great influence on overall properties of the toner mother particles. In order to impart excellent low-temperature fixability to the toner, the toner mother particles preferably contain a thermoplastic resin as the binder resin, and more preferably contain a thermoplastic resin in an amount of at least 85% by mass relative to the total amount of the binder resin. Examples of the thermoplastic resin include styrene-based resins, acrylic acid ester-based resins, olefin-based resins (specific examples include polyethylene resin and polypropylene resin), vinyl resins (specific examples include vinyl chloride resin, polyvinyl alcohol, vinyl ether resin, and N-vinyl resin), polyester resins, polyamide resins, and urethane resins. A copolymer of any of the above-listed resins, that is, a copolymer formed through introduction of a repeating unit into any of the above-listed resins (specific examples include styrene-acrylic acid ester-based resin and styrene-butadiene-based resin) can also be used as the binder resin.

A thermoplastic resin can be obtained through addition polymerization, copolymerization, or condensation polymerization of at least one thermoplastic monomer. Note that a thermoplastic monomer is a monomer that forms a thermoplastic resin through homopolymerization (specific examples include acrylic acid ester-based monomers and styrene-based monomers) or a monomer that forms a thermoplastic resin through condensation polymerization (for example, a combination of a polyhydric alcohol and a polybasic carboxylic acid that form a polyester resin through condensation polymerization).

In order to impart excellent low-temperature fixability to the toner, the toner mother particles preferably contain a polyester resin as the binder resin, and more preferably contain a polyester resin in an amount of at least 80% by mass and no greater than 100% by mass relative to the total amount of the binder resin. A polyester resin can be obtained through condensation polymerization of at least one polyhydric alcohol and at least one polybasic carboxylic acid. Examples of polyhydric alcohols that can be used for synthesis of a polyester resin include dihydric alcohols (specific examples include aliphatic diols and bisphenols) and tri- or higher-hydric alcohols listed below. Examples of polybasic carboxylic acids that can be used for synthesis of a polyester resin include dibasic carboxylic acids and tri- or higher-basic carboxylic acids listed below. Note that a polybasic carboxylic acid derivative (specific examples include an anhydride of a polybasic carboxylic acid and a halide of a polybasic carboxylic acid) that can form an ester bond through condensation polymerization may be used instead of the polybasic carboxylic acid.

Preferable examples of the aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, 1,10-decanedicarboxylic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexartetricarboxylic acid, tetra(methylenecarboxyl)methane, 1,2,7,8-octanetetracarboxylic acid, pyromellitic acid, and Empol trimer acid.

(Colorant)

The toner mother particles may contain a colorant. A known pigment or dye that matches the color of the toner can be used as the colorant. In order to form high-quality images with use of the toner, the amount of the colorant is preferably at least 1 part by mass and no greater than 20 parts by mass relative to 100 parts by mass of the binder resin.

The toner mother particles may contain a black colorant. Carbon black can for example be used as the black colorant. Alternatively, a colorant adjusted to black color using a yellow colorant, a magenta colorant, and a cyan colorant may be used as a black colorant.

The toner mother particles may contain a non-black colorant. Examples of the non-black colorant include yellow colorants, magenta colorants, and cyan colorants.

At least one compound selected from the group consisting of condensed azo compounds, isoindolinone compounds, anthraquinone compounds, azo metal complexes, methine compounds, and arylamide compounds can for example be used as a yellow colorant. Examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as a magenta colorant. Examples of the magenta colorant include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can for example be used as a cyan colorant. Examples of the cyan colorant include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles may contain a releasing agent. The releasing agent may be used in order to impart for example excellent offset resistance to the toner. The amount of the releasing agent is preferably at least 1 part by mass and no greater than 20 parts by mass relative to 100 parts by mass of the binder resin in order to impart excellent offset resistance to the toner.

Examples of the releasing agent include ester waxes, polyolefin waxes (specific examples include polyethylene wax and polypropylene wax), microcrystalline wax, fluororesin wax, Fischer-Tropsch wax, paraffin wax, candelilla wax, montan wax, and castor wax. Examples of the ester waxes include natural ester waxes (specific examples include carnauba wax and rice wax) and synthetic ester waxes. In the present embodiment, one releasing agent may be used independently or two or more releasing agents may be used in combination.

A compatibilizer may be added to the toner mother particles in order to improve compatibility between the binder resin and the releasing agent.

(Charge Control Agent)

The toner mother particles may contain a charge control agent. The charge control agent is used in order to impart for example excellent charge stability or an excellent charge rise characteristic to the toner. The charge rise characteristic of toner is an indicator as to whether or not the toner is chargeable to a specific charge level in a short period of time.

As a result of the toner mother particles containing a positively chargeable charge control agent, cationic strength (positive chargeability) of the toner mother particles can be increased. As a result of the toner mother particles containing negatively chargeable charge control agent by contrast, anionic strength (negative chargeability) of the toner mother particles can be increased.

Examples of the positively chargeable charge control agent include: azine compounds such as pyridazine, pyrimidine, pyrazine, 1,2-oxazine, 1,3-oxazine, 1,4-oxazine, 1,2-thiazine, 1,3-thiazide, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; alkoxylated amine; alkylamide; quaternary ammonium salts such as benzyldecylhexylmethyl ammonium chloride, decyltrimethyl ammonium chloride, 2-(methacryloyloxy)ethyl trimethylammonium chloride, and dimethylaminopropyl acrylamide methyl chloride quaternary salt; and a resin having a quaternary ammonium cation group. One of the charge control agents listed above may be used independently, or two or more of the charge control agents listed above may be used in combination.

Examples of the negatively chargeable charge control agent include organic metal complexes, which are chelate compounds. A preferable organic metal complex is at least one selected from the group consisting of metal acetylacetonate complexes, salicylic acid-based metal complexes, and salts of them.

In order to impart excellent charge stability to the toner, the amount of the charge control agent is preferably at least 0.1 parts by mass and no greater than 20 parts by mass relative to 100 parts by mass of the binder resin.

(Magnetic Powder)

The toner mother particles may contain a magnetic powder. Examples of materials of the magnetic powder include ferromagnetic metals (specific examples include iron, cobalt, and nickel), alloys of the ferromagnetic metals, ferromagnetic metal oxides (specific examples include ferrite, magnetite, and chromium dioxide), and materials subjected to ferromagnetization (specific examples include carbon materials rendered ferromagnetic through thermal treatment). In the present embodiment, one magnetic powder may be used independently or two or more magnetic powders may be used in combination.

(External Additive)

The toner particles included in the toner according to the present embodiment may further include an external additive (a powder of external additive particles) attached to the surfaces of the toner mother particles. In the present embodiment, one type of external additive particles may be used independently or two or more types of external additive particles may be used in combination.

In order to impart excellent fluidity to the toner, the external additive particles constituting the external additive are preferably inorganic oxide particles, and more preferably at least one selected from the group consisting of silica particles and particles of metal oxides (specific examples include alumina, titanium oxide, magnesium oxide, zinc oxide, strontium titanate, and barium titanate).

In order to obtain a toner having excellent fluidity, the external additive particles constituting the external additive preferably have a number average primary particle diameter of at least 5 nm and no greater than 500 nm.

The external additive particles may have been subjected to surface treatment. For example, where silica particles are used as the external additive particles, the surfaces of the silica particles may have hydrophobicity and/or positive chargeability imparted by a surface treatment agent. Examples of the surface treatment agent include coupling agents (specific examples include silane coupling agents, titanate coupling agents, and aluminate coupling agents), silazane compounds (specific examples include chain silazane compounds and cyclic silazane compounds), and silicone oils (specific examples include dimethyl silicone oil). The surface treatment agent is particularly preferably at least one selected from the group consisting of silane coupling agents and silazane compounds. Preferable examples of the silane coupling agents include silane compounds (specific examples include methyltrimethoxysilane and aminosilane). Preferable examples of the silazane compounds include hexamethyldisilazane (HMDS). When surfaces of silica bases (untreated silica particles) are treated with a surface treatment agent, part or all of a number of hydroxyl groups (—OH) present on the surface of the silica base are replaced with functional groups derived from the surface treatment agent. As a result, obtained silica particles have functional groups derived from the surface treatment agent (specifically, functional groups having higher hydrophobicity and/or higher positive chargeability than the hydroxyl groups) on the surfaces thereof.

The amount of the external additive is preferably at least 0.1 parts by mass and no greater than 10.0 parts by mass relative to 100 parts by mass of the toner mother particles in order to allow the external additive to sufficiently exert its function while inhibiting separation of the external additive from the toner mother particles.

{Zinc Stearate Particles}

Next, the zinc stearate particles will be described.

The zinc stearate particles together with the toner particles constitute the toner according to the present embodiment. No particular limitations are placed on a method for producing the zinc stearate particles. In the toner according to the present embodiment, commercially available zinc stearate particles may be used. The zinc stearate particles may have been subjected to surface treatment (specific examples include a treatment for imparting positive chargeability).

In order to further inhibit occurrence of image deletion by increasing adhesion of the zinc stearate particles to the surface of an image bearing member, the zinc stearate particles preferably have a number average roundness of no greater than 0.87, and more preferably no greater than 0.83. Further, in order to prevent damage to the surface of the image bearing member, the zinc stearate particles preferably have a number average roundness of at least 0.80. Note that the number average roundness of the zinc stearate particles refers to a number average roundness of the zinc stearate particles of a powder as a measurement target measured by the same method as that described below in association with Examples or a method conforming therewith.

In order to facilitate adjustment of the number average roundness of the zinc stearate particles to within the above-described preferable range (at least 0.80 and no greater than 0.87), the zinc stearate particles are preferably produced by a wet method. The "wet method" refers to a method for producing zinc stearate particles by a wet reaction of an alkali metal salt or ammonium salt of stearic acid with an inorganic salt of zinc. The particle diameter and the number average roundness of the zinc stearate particles can each be adjusted for example by changing the conditions of the wet reaction when the zinc stearate particles are produced by a wet method.

In order to inhibit occurrence of fogging while further inhibiting occurrence of image deletion, it is preferable to use zinc stearate particles having a 50% volume cumulative diameter of at least 5.0 μm and no greater than 6.0 μm and a number average roundness of no greater than 0.83.

Example of a method for adjusting the particle size distribution of the zinc stearate particles (specifically, a method for adjusting the $StD_{50}$, the $StR_{D\leq 1}$, and the $StR_{D\geq 10}$) include a method in which a powder of zinc stearate produced by a known method (specific example include a wet method) is classified. In a case where a powder of zinc stearate particles is classified, the powder of the zinc stearate particles may be pulverized before classification.

The following describes a method in which a powder of zinc stearate particles is classified using an air classifier utilizing Coanda effect as an example of the method for adjusting the particle size distribution of zinc stearate particles with reference to drawings. The air classifier utilizing Coanda effect may be simply referred to below as an "air classifier".

Figure 2:
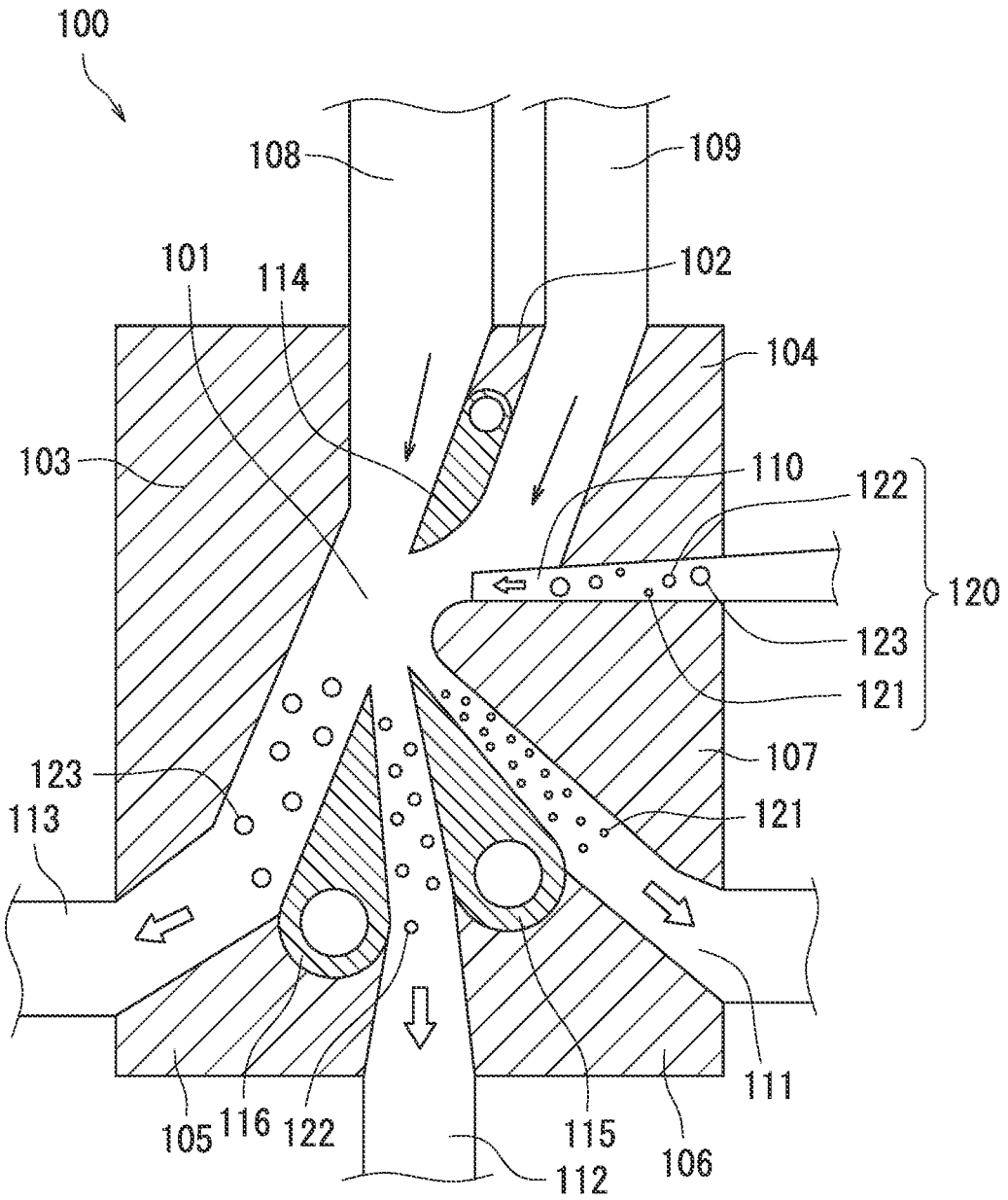
FIG. 2 is a partial cross-sectional view of an example of an air classifier.
Figure 3:
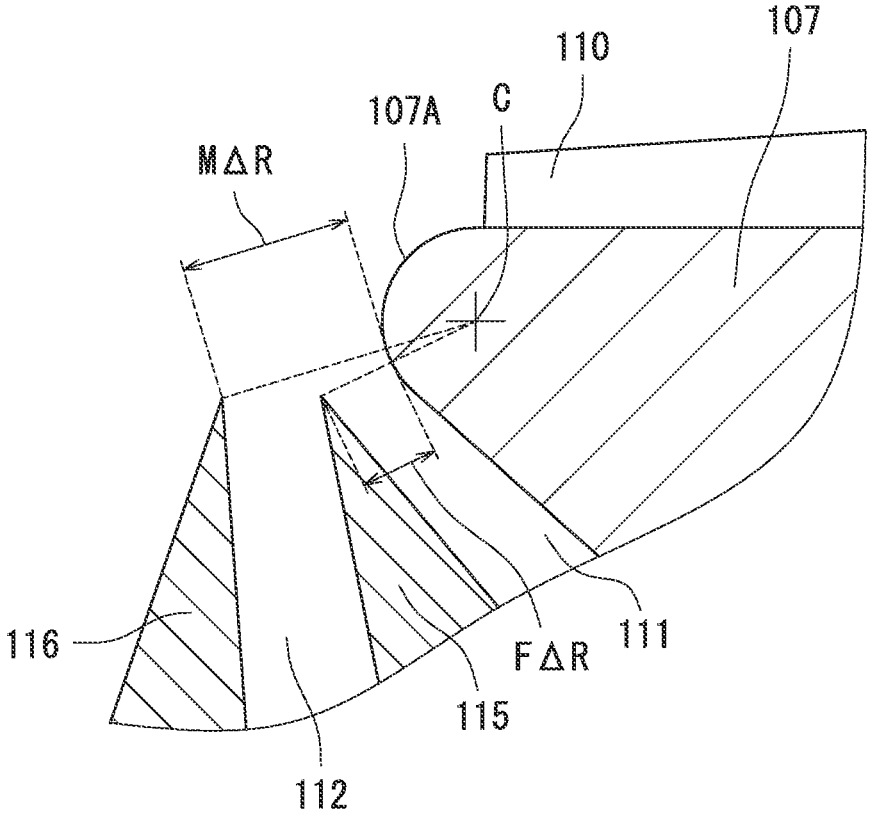
FIG. 3 is an enlarged cross-sectional view of a Coanda block and elements therearound in the air classifier illustrated in FIG. 2.

FIG. 2 to be referred to is a partial cross-sectional view of an example of an air classifier. Also, FIG. 3 to be referred to is an enlarged cross-sectional view of a Coanda block and elements therearound in the air classifier illustrated in FIG. 2. Note that FIGS. 2 and 3 schematically illustrates elements of configuration in order to facilitate understanding. Properties such as size and shape, and the number of the elements of configuration illustrated in the drawing may differ from actual properties and the number thereof in order to facilitate preparation of the drawing.

The air classifier 100 illustrated in FIG. 2 includes a classification chamber 101, an upper wall 102, a first side wall 103, a second side wall 104, a first lower wall 105, a second lower wall 106, and a Coanda block 107. The upper wall 102, the first side wall 103, the second side wall 104, the first lower wall 105, the second lower wall 106, and the Coanda block 107 are arranged so as to surround the classification chamber 101.

A first intake channel 108 that opens to the classification chamber 101 is located between the upper wall 102 and the first side wall 103. A second air intake channel 109 that opens to the classification chamber 101 is located between the upper wall 102 and the second side wall 104. A powder supply flow channel 110 that opens to the classification chamber 101 is located between the second side wall 104 and the Coanda block 107. A first discharge flow channel 111 that opens to the classification chamber 101 is located between the second lower wall 106 and the Coanda block 107. A second discharge flow channel 112 that opens to the classification chamber 101 is located between the first lower wall 105 and the second lower wall 106. A third discharge flow channel 113 that opens to the classification chamber 101 is located between the first side wall 103 and the first lower wall 105.

Further, the upper wall 102 has an air intake edge 114. The intake edge 114 is rotatably provided at an end of the upper wall 102. By changing the angle of the intake edge 114, respective amounts of gas inflowing from the first air intake channel 108 and the second air intake channel 109 can be adjusted. The second lower wall 106 has a first classification edge 115. The first classification edge 115 is rotatably provided at an end of the second lower wall 106. By changing the angle of the first classification edge 115, FΔR (see FIG. 3) described later can be adjusted. The first lower wall 105 has a second classification edge 116. The second classification edge 116 is rotatably provided at an end of the first lower wall 105. By changing the angle of the second classification edge 116, MΔR (see FIG. 3) described later can be adjusted.

The following describes a method for classifying a powder 120 of zinc stearate particles including a powder of small diameter particles 121, a powder of medium diameter particles 122, and a powder of large diameter particles 123 using the air classifier 100. The powder of the small diameter particles 121, the powder of the medium diameter particles 122, and the powder of the large diameter particles 123 each have a specific particle size distribution.

First, the angle of the first classification edge 115 and the angle of the second classification edge 116 are changed so as to obtain a desired particle size distribution (specifically, $StD_{50}$, $StR_{D\leq1}$, and $StR_{D\geq10}$). As illustrated in FIG. 3, by changing the angle of the first classification edge 115, it is possible to adjust a distance from a tip of the first classification edge 115 to the Coanda block 107 (referred to below as FΔR) on a straight line connecting a center C of a sector including an arc 107A of the Coanda block 107 to the tip of the first classification edge 115. Also, by changing the angle of the second classification edge 116, it is possible to adjust a distance from a tip of the second classification edge 116 to the Coanda block 107 (referred to below as MΔR) on a straight line connecting the center C of the sector including the arc 107A of the Coanda block 107 to the tip of the second classification edge 116.

Description of the classification method using the air classifier 100 will be continued with further reference to FIG. 2. After changing the angle of the first classification edge 115 and the angle of the second classification edge 116 as described above, the pressure inside the classification chamber 101 is reduced via the first discharge flow channel 111, the second discharge flow channel 112, and the third discharge flow channel 113. Subsequently, the powder 120 of the zinc stearate particles is supplied to the classification chamber 101 via the powder supply flow channel 110. As a result, the powder 120 of the zinc stearate particles draws a curve under the Coanda effect due to the Coanda block 107 and an action of a gas flowing from the first air intake channel 108 and the second air intake channel 109. Then the small diameter particles 121 are mainly discharged through the first discharge flow channel 111 located the closest to the Coanda block 107. Also, the large diameter particles 123 are mainly discharged through the third discharge flow channel 113 located the farthest from the Coanda block 107. Further, the medium diameter particles 122 are mainly discharged through the second discharge flow channel 112 located between the first discharge flow channel 111 and the third discharge flow channel 113.

The powder discharged through the first discharge flow channel 111 may be referred to below as a powder F. Also, the powder discharged through the second discharge flow channel 112 may be referred to below as a powder M. Further, the powder discharged through the third discharge flow channel 113 may be referred to below as a powder G. Through the above-described classification method, it is possible to obtain a powder of zinc stearate particles having an adjusted particle size distribution in which the $StD_{50}$ is at least 3.0 μm and no greater than 6.0 μm and the $StR_{D\leq1}$ and the $StR_{D\geq10}$ are no greater than 2.0% by volume as powders F, M, or G.

<Toner Production Methods>

The following describes a preferable method for producing the toner according to the above-described embodiment. Description of elements overlapping with description of those of the toner according to the embodiment described above is omitted.

[Toner Mother Particles Preparation Process]

First, toner mother particles are prepared by an aggregation method or a pulverization method.

The aggregation method includes an aggregation step and a coalescence step, for example. The aggregation step involves causing fine particles containing components constituting the toner mother particles to aggregate in an aqueous medium to form aggregated particles. The coalescence step involves causing the components contained in the aggregated particles to coalesce in the aqueous medium to form toner mother particles.

The following describes the pulverization method. Through the pulverization method, the toner mother particles can be prepared in a relatively easy manner, and the production cost can be reduced. In a case where the toner mother particles are prepared by the pulverization method, the toner mother particle preparation process includes for example a melt-kneading step and a pulverization step. The toner mother particle preparation process may further include a mixing step before the melt-kneading step. The toner mother particle preparation process may further include, after the pulverization step, at least one of a fine pulverization step and a classification step.

The mixing step involves mixing the binder resin and an internal additive to be added depending on necessity thereof to yield a mixture. The melt-kneading step involves melting and kneading toner materials to yield a melt-kneaded product. The toner materials used in the melt-kneading step are a mixture yielded in the mixing step, for example. The pulverization step involves cooling the resultant melt-kneaded product for example to room temperature (25° C.) followed by pulverization to yield a pulverized product. In a case where reduction in diameter of the pulverized product as a result of performance of the pulverization step is needed, a step of further pulverizing the pulverized product (fine pulverization step) may be performed. Furthermore, in order to equalize the particle diameter of the pulverized product, a step of classifying the resultant pulverized product (classification step) may be performed. Through the above steps, the toner mother particles as the pulverized product are obtained.

[External Addition Process]

Thereafter, the resultant toner mother particles and an external additive may be mixed together using a mixer (for example, an FM mixer produced by Nippon Coke & Engineering Co., Ltd.) to attach the external additive to the surfaces of the toner mother particles if necessary. Note that the toner mother particles may be used as toner particles without undergoing external additive addition. Through the above, a powder of the toner particles is obtained.

[Process for Mixing Toner Particles and Zinc Stearate Particles]

Subsequently, the obtained powder of the toner particles and the powder of the zinc stearate particles are mixed using a mixer (for example, an FM mixer produced by Nippon Coke & Engineering Co., Ltd.) to obtain a toner including the powder of the toner particles and the powder of the zinc stearate particles. The powder of the zinc stearate particles used in the mixing step is a powder having an adjusted particle size distribution in which the $StD_{50}$ is at least 3.0 μm and no greater than 6.0 μm and the $StR_{D\leq1}$ and the $StR_{D\geq10}$ are no greater than 2.0% by volume.

In a case where a toner containing toner particles each including an external additive is produced, it is also possible to obtain a toner including a powder of toner particles and a powder of zinc stearate particles by simultaneously mixing the powder of toner particle, the external additive, and the powder of zinc stearate particles under stirring.

EXAMPLES

The following describes examples of the present disclosure. However, the present disclosure is not limited to the scope of the examples. First, a method for measuring a number average roundness of zinc stearate particles and a method for measuring $StD_{50}$, $StR_{D\leq1}$, and $StR_{D\geq10}$ will be described.

<Method for Measuring Number Average Roundness of Zinc Stearate Particles>

A sample (one of powders PA-1 to PA-4 and PB-1 to PB-6 of zinc stearate particles described later) was photographed using a scanning electron microscope ("JSM-7401F", product of JEOL Ltd.), and an obtained image was analyzed using image analysis software ("WinROOF", product of MITANI Corp.). Specifically, 100 particles were randomly selected from zinc stearate particles present in the image, and the roundness of each of the 100 particles (perimeter of a circle having an area equal to the projected area of each particle/perimeter of the particle) was determined. A number average value was calculated from the measured roundness values of the 100 particles, and the obtained value was taken to be a number average roundness of the zinc stearate particles.

<Method for Measuring $StD_{50}$, $StR_{D\leq1}$, and $StR_{D\geq10}$>

First, 40 g of ethanol and 0.5 g of a sample (one of the powders PA-1 to PA-4 and PB-1 to PB-6 of zinc stearate particles described later) were added into a beaker (volume: 100 mL). Next, the sample in the beaker was ultrasonically treated for 1 minute using an ultrasonic cleaner ("VS-F100", available from AS ONE Corporation, oscillation frequency: 50 kHz) to obtain a dispersion for measurement. Next, the obtained dispersion for measurement was loaded into a laser diffraction/scattering particle size distribution analyzer ("LA-950", product of Horiba, Ltd.) to measure a volume particle size distribution of the sample. Then, the $StD_{50}$, the $StR_{D\leq1}$, and the $StR_{D\geq10}$ of the sample were determined from the measured volume particle size distribution.

<Preparation of Powders of Zinc Stearate Particles>

The following describes a method for preparing the powders PA-1 to PA-4 and PB-1 to PB-6 of zinc stearate particles. The powders PA-1 to PA-4 and PB-1 to PB-6 of zinc stearate particles may be referred to below as powders PA-1 to PA-4 and PB-1 to PB-6, respectively.

[Preparation of Powder PA-1]

A powder of zinc stearate particles produced by a wet method ("SZ-2000", product of Sakai Chemical Industry Co., Ltd.) is classified using an air classifier ("ELBOW JET model EJ-LABO", product of Nittetsu Mining Co., Ltd.) under the following classification conditions to separately collect a powder M. Thus, a powder PA-1 being the powder M was obtained. The number average roundness of the zinc stearate particles in the powder PA-1 was 0.81. Note that the same result as to the number average roundness of the stearate particles therein was obtained even when measurement was made on a powder PA-1 separated from a toner produced by a method described below as a measurement target. The same applied to the number average roundness of zinc stearate particles included in the respective powders PA-2 to PA-4 and PB-1 to PB-6 described below.

(Classification Conditions)

Input frequency: 24 Hz
Air flow control: Automatic control
Injector pressure: 0.5 MPa
FΔR: 8.0 mm
MΔR: 15.0 mm

[Preparation of Powder PA-2]

A powder PA-2 being a powder M was obtained by the same method as that for preparation of the powder PA-1 in all aspects other than that MΔR was changed to 20.0 mm. The number average roundness of the zinc stearate particles in the powder PA-2 was 0.82.

[Preparation of Powder PA-3]

A powder PA-3 being a powder M was obtained by the same method as that for preparation of the powder PA-1 in all aspects other than that FΔR and MΔR were changed to 10.0 mm and 20.0 mm, respectively. The number average roundness of the zinc stearate particles in the powder PA-3 was 0.82.

[Preparation of Powder PA-4]

A powder PA-4 being a powder M was obtained by the same method as that for preparation of the powder PA-1 in all aspects other than that MΔR was changed to 18.0 mm. The number average roundness of the zinc stearate particles in the powder PA-4 was 0.81.

[Preparation of Powder PB-1]

A powder PB-1 being a powder F was obtained by the same method as that for preparation of the powder PA-1 in all aspects other than that FΔR was changed to 2.0 mm and separate collection for only a powder F was done. The number average roundness of the zinc stearate particles in the powder PB-1 was 0.82.

[Preparation of Powder PB-2]

A powder PB-2 being a powder F was obtained by the same method as that for preparation of the powder PA-1 in all aspects other than that FΔR was changed to 3.5 mm and separate collection for only a powder F was done. The number average roundness of the zinc stearate particles in the powder PB-2 was 0.80.

[Preparation of Powder PB-3]

A powder PB-3 being a powder M was obtained by the same method as that for preparation of the powder PA-1 in all aspects other than that FΔR was changed to 5.0 mm. The number average roundness of the zinc stearate particles in the powder PB-3 was 0.82.

[Preparation of Powder PB-4]

A powder PB-4 being a powder M was obtained by the same method as that for preparation of the powder PA-1 in all aspects other than that FΔR and MΔR were changed to 10.0 mm and 22.0 mm, respectively. The number average roundness of the zinc stearate particles in the powder PB-4 was 0.81.

[Preparation of Powder PB-5]

A powder PB-5 being a powder M was obtained by the same method as that for preparation of the powder PA-1 in all aspects other than that FΔR and MΔR were changed to 10.0 mm and 25.0 mm, respectively. The number average roundness of the zinc stearate particles in the powder PB-5 was 0.82.

[Preparation of Powder PB-6]

A powder of zinc stearate particles ("SZ-2000", product of Sakai Chemical Industry Co., Ltd.) was prepared as a powder PB-6. The powder PB-6 was not subjected to classification. The number average roundness of the zinc stearate particles in the powder PB-6 was 0.80.

Table 1 shows $StD_{50}$, $StR_{D\leq1}$, and $StR_{D\geq10}$ for each of the powders PA-1 to PA-4 and PB-1 to PB-6 of zinc stearate particles. Note that the same results as to $StD_{50}$, $StR_{D\leq1}$, and $StR_{D\geq10}$ were obtained even when measurement was made on a powder (each of powders PA-1 to PA-4 and PB-1 to PB-6) separated from a toner produced by a method described below as a measurement target.

TABLE 1

| Powder of zinc stearate particles | $StD_{50}$ [μm] | $StR_{D\leq1}$ [% by volume] | $StR_{D\geq10}$ [% by volume] |
|---|---|---|---|
| PA-1 | 3.1 | 1.9 | 0.4 |
| PA-2 | 3.3 | 1.8 | 1.9 |
| PA-3 | 5.8 | 0.8 | 1.9 |
| PA-4 | 5.0 | 1.9 | 1.2 |
| PB-1 | 1.1 | 45.0 | 0.0 |
| PB-2 | 2.7 | 19.0 | 0.2 |
| PB-3 | 3.1 | 3.0 | 0.2 |
| PB-4 | 5.9 | 0.9 | 2.5 |
| PB-5 | 6.5 | 0.5 | 5.1 |
| PB-6 | 11.2 | 3.5 | 60.0 |

<Production of Toner Particles TA>

[Synthesis of Binder Resin]

A 5-L four-necked flask equipped with a thermometer (a thermocouple), a drainage tube, a nitrogen inlet tube, a rectification column, and a stirrer was placed in a thermostat bath and charged with 1,200 g of 1,2-propanediol, 1,700 g of terephthalic acid, and 3 g of tin(II) dioctanoate. Subsequently, a reaction (specifically, a condensation reaction) of the flask contents was allowed to proceed at a temperature of 230° C. in a nitrogen atmosphere for 15 hours. Subsequently, the internal pressure of the flask was reduced, and the flask contents were allowed to react at a temperature of 230° C. in the reduced pressure atmosphere (pressure: 8.0 kPa) until Tm of a reaction product (a polyester resin) reached a specific temperature (90° C.) As a result, a polyester resin for use as a binder resin was obtained. The resultant polyester resin had a Tm of 90° C.

[Preparation of Toner Mother Particles]

An FM mixer ("FM-20B", product of Nippon Coke & Engineering Co., Ltd.) was used to mix 80 parts by mass of the polyester resin obtained by the synthesis method as described above, 9 parts by mass of a releasing agent ("NISSAN ELECTOL (registered Japanese trademark) WEP-3", product of NOF Corporation, component: ester wax), 9 parts by mass of a colorant ("MA100", product of Mitsubishi Chemical Corporation, component: carbon black), and 1 part by mass of a positively chargeable charge control agent ("BONTRON (registered Japanese trademark) P-51", product of ORIENT CHEMICAL INDUSTRIES, Co., Ltd.) at a rotational speed of 2,000 rpm for 4 minutes.

Subsequently, the resultant mixture was melt-kneaded using a twin-screw extruder ("PCM-30", product of Ikegai Corp.) under conditions of a material feeding rate of 5 kg/hour, a shaft rotational speed of 150 rpm, and a cylinder temperature of 100° C. Then, the resultant melt-kneaded product was cooled. Subsequently, the cooled melt-kneaded product was coarsely pulverized using a pulverizer ("ROTOPLEX (registered Japanese trademark)", product of Hosokawa Micron Corporation). The resultant coarsely pulverized product was finely pulverized using a pulverizer ("TURBO MILL Model RS", product of FREUND-TURBO CORPORATION). Subsequently, the resultant finely pulverized product was classified using an air classifier ("ELBOW JET Model EJ-LABO", product of Nittetsu Mining Co., Ltd.). Through the above, toner mother particles having a volume median diameter ($D_{50}$) of 6.7 μm were obtained.

[External Addition of External Additive]

An FM mixer ("FM-10B", product of Nippon Coke & Engineering Co., Ltd.) was charged with 100 parts by mass of toner mother particles (the toner mother particles obtained by the above-described preparation method), 1.5 parts by mass of hydrophobic silica particles ("AEROSIL (registered Japanese trademark) RA-200 HS", product of Nippon Aerosil Co., Ltd., number average primary particle diameter: 12 nm), and 1.0 part by mass of conductive titanium oxide particles ("EC-100", product of Titan Kogyo, Ltd., number average primary particle diameter: 350 nm). Subsequently, the toner mother particles and the external additives (the hydrophobic silica particles and the conductive titanium oxide particles) were mixed using the FM mixer under conditions of a rotational speed of 3,000 rpm and a jacket temperature of 20° C. for 5 minutes. Through the above, the entire amount of the external additives were attached to the surfaces of the toner mother particles.

Subsequently, the obtained powder was sieved using a 200-mesh sieve (aperture 75 μm). As a result, a powder of toner particles TA was obtained. Note that the composition ratio of the components constituting the toner particles TA did not change between before and after the sieving.

<Production of Toners>

[Production of Toner TA-1]

An FM mixer ("FM-10B", product of Nippon Coke & Engineering Co., Ltd.) was charged with the powder of the toner particles TA obtained by the above-described production method and the powder PA-1 obtained by the above-described preparation method. The amount of the powder PA-1 added into the FM mixer was 0.20 parts by mass relative to 100 parts by mass of the toner mother particles included in the powder of the toner particles TA. Subsequently, the powder of the toner particles TA and the powder PA-1 were mixed using the FM mixer under conditions of a rotational speed of 3,000 rpm and a jacket temperature of 20° C. for 5 minutes. As a result, a positively chargeable toner TA-1 was obtained.

[Production of Toners TA-2 to TA-4 and TB-1 to TB-6]

Toners TA-2 to TA-4 and TB-1 to TB-6 were produced by the same method as that for production of the toner TA-1 in all aspects other than that types of zinc stearate particles were as shown in Table 2 below.

<Evaluation Method>

The following describes a method for evaluating the toners TA-1 to TA-4 and TB-1 to TB-6.

[Preparation of Two-Component Developer]

Using a ball mill, 100 parts by mass of a carrier for "TASKalfa 3252ci" produced by KYOCERA Document Solutions Inc. and 8 parts by mass of a toner (evaluation target: one of the toners TA-1 to TA-4 and TB-1 to TB-6) were mixed for 30 minutes to prepare a two-component developer for evaluation.

[Image Deletion]

A color multifunction peripheral ("TASKalfa 3252ci", product of KYOCERA Document Solutions Inc., image bearing member: a photosensitive drum including a photosensitive layer containing amorphous silicon) was used as an evaluation apparatus. A two-component developer containing an evaluation target (a two-component developer prepared by the above-descried method) was loaded into a black-color development device of the evaluation apparatus, and a toner for evaluation (evaluation target: one of the toners TA-1 to TA-4 and TB-1 to TB-6) was loaded into a black-color toner container. Next, an image having a printing rate of 20% was consecutively printed on 30,000 sheets of paper (A4 size plain paper) using the evaluation apparatus in an environment at a temperature of 23° C. and a relative humidity of 50%. Then, the evaluation apparatus after the printing was left to stand for 12 hours in an environment at a temperature of 32.5° C. and a relative humidity of 80%.

Next, using the evaluation apparatus after being left to stand for 12 hours, a halftone image (image density: 50%) was output on an entire surface of a sheet of printing paper (A4 size plain paper) in an environment at a temperature of 32.5° C. and a relative humidity of 80%. Subsequently, the output image was visually observed to determine the presence or absence of image deletion. When image deletion was observed, drum refreshing described below was performed one to six times, and the halftone image (image density 50%) was printed on another sheet of printing paper (A4 size plain paper) to determine the presence or absence of image deletion. Based on the printing result, determination was made in accordance with the following determination criteria. A toner having a printing result rated as A or B was evaluated as "occurrence of image deletion being inhibited", and a toner having a printing result rated as C was evaluated as "occurrence of image deletion being not inhibited".

(Determination Criteria for Image Deletion)

A: No image deletion was observed in the first printing.

B: Image deletion was observed in the first printing, but no image deletion was observed in the printing performed after the drum refreshing described below was performed once to six times.

C: Image deletion was observed in the first printing, and image deletion was still observed in the printing performed after the drum refreshing described below was preformed six times.

(Drum Refreshing)

The drum refreshing was performed according to the method described below. First, a toner layer was formed on a development sleeve of the evaluation apparatus without feeding any paper. Subsequently, the photosensitive drum of the evaluation apparatus was irradiated with light to form an electrostatic latent image for solid image formation over the entire circumferential surface of the photosensitive drum. The toner was then supplied from the toner layer on the development sleeve to the photosensitive drum to form a toner image (toner image corresponding to a black solid image) over the entire circumferential surface of the photosensitive drum. Next, the photosensitive drum was caused to idle for 1 minute just to polish the surface of the photosensitive drum with toner collected by a cleaner of the evaluation apparatus.

[Fogging]

A color multifunction peripheral ("TASKalfa 3252ci", product of KYOCERA Document Solutions Inc., image bearing member: a photosensitive drum including a photosensitive layer containing amorphous silicon) was used as an evaluation apparatus. A two-component developer containing an evaluation target (a two-component developer prepared by the above-descried method) was loaded into a black-color development device of the evaluation apparatus, and a toner for evaluation (evaluation target: one of the toners TA-1 to TA-4 and TB-1 to TB-6) was loaded into a black-color toner container. Next, an image having a printing rate of 20% was consecutively printed on 30,000 sheets of paper (A4 size plain paper) using the evaluation apparatus in an environment at a temperature of 23° C. and a relative humidity of 50%.

Next, using the evaluation apparatus, an image having a printing rate of 5% was printed on a sheet of printing paper (A4 size plain paper) in an environment at a temperature of 23° C. and a relative humidity of 50% to obtain an evaluation image. The image density (ID) of a blank portion of the obtained evaluation image was measured using a reflectance densitometer ("SpectroEye (registered Japanese trademark)", product of X-Rite Inc.), and a fogging density (FD) was calculated. The fogging density (FD) corresponds to a value obtained by subtracting the image density (ID) of a base paper (unprinted paper) from the image density (ID) of the blank portion of the evaluation image.

Based on the obtained fogging density (FD), determination was made in accordance with the following determination criteria. A toner that formed an image having a fogging density rated as A was evaluated as "occurrence of fogging being inhibited", and a toner that formed an image having a fogging density rated as B was evaluated as "occurrence of fogging being not inhibited".

(Determination Criteria for Fogging)

A: The fogging density (FD) was no greater than 0.003.

B: The fogging density (FD) was greater than 0.003.

<Evaluation Results>

Table 2 shows the type of the powder of zinc stearate particles, the determination result of image deletion, and the determination result of fogging for each of the toners TA-1 to TA-4 and TB-1 to TB-6.

TABLE 2

| | Toner | Powder of zinc stearate particles | Evaluation result of image deletion | Evaluation result of togging |
|---|---|---|---|---|
| Example 1 | TA-1 | PA-1 | B | A |
| Example 2 | TA-2 | PA-2 | B | A |
| Example 3 | TA-3 | PA-3 | A | A |
| Example 4 | TA-4 | PA-4 | A | A |
| Comparative Example 1 | TB-1 | PB-1 | C | A |
| Comparative Example 2 | TB-2 | PB-2 | C | A |
| Comparative Example 3 | TB-3 | PB-3 | C | A |
| Comparative Example 4 | TB-4 | PB-4 | A | B |
| Comparative Example 5 | TB-5 | PB-5 | A | B |
| Comparative Example 6 | TB-6 | PB-6 | C | B |

As shown in Tables 1 and 2, each of the toners TA-1 to TA-4 had a $StD_{50}$ of at least 3.0 μm and no greater than 6.0 μm, a $StR_{D\leq1}$ of no greater than 2.0% by volume, and $StR_{D\geq10}$ of no greater than 2.0% by volume.

As shown in Table 2, the toners TA-1 to TA-4 each had a determination result of image deletion rated as A or B. Thus, use of any of the toners TA-1 to TA-4 inhibited occurrence of image deletion. The toners TA-1 to TA-4 each had a determination result of fogging rated as A. Thus, use of any of the toners TA-1 to TA-4 inhibited occurrence of fogging.

As shown in Tables 1 and 2, the toners TB-1 and TB-2 had a $StD_{50}$ of less than 3.0 μm. The toners TB-5 and TB-6 had a $StD_{50}$ of greater than 6.0 μm. The toners TB-1 to TB-3 and TB-6 had a $StR_{D\leq1}$ of greater than 2.0% by volume. The toners TB-4 to TB-6 had a $StR_{D\geq10}$ of greater than 2.0% by volume.

As shown in Table 2, the toners TB-1 to TB-3 and TB-6 each had a determination result of image deletion rated as C. Thus, use of any of the toners TB-1 to TB-3 and TB-6 did not inhibit occurrence of image deletion. The toners TB-4 to TB-6 each had a determination result of fogging rated as B. Thus, use of any of the toners TB-4 to TB-6 did not inhibit occurrence of fogging.

The above results showed that with use of the toner according to the present disclosure, occurrence of fogging can be inhibited while inhibiting occurrence of image deletion.

What is claimed is:

1. A toner comprising toner particles and zinc stearate particles, wherein the toner particles each include a toner mother particle containing a binder resin, the zinc stearate particles have a 50% volume cumulative diameter of at least 3.0 μm and no greater than 6.0 μm, a presence ratio of the zinc stearate particles having a particle diameter of no greater than 1.0 μm is no greater than 2.0% by volume relative to a total amount of the zinc stearate particles, and a presence ratio of the zinc stearate particles having a particle diameter of at least 10.0 μm is no greater than 2.0% by volume relative to the total amount of the zinc stearate particles.

2. The toner according to claim 1, wherein an amount of the zinc stearate particles is at least 0.02 parts by mass and no greater than 0.50 parts by mass relative to 100 parts by mass of the toner mother particles.

3. The toner according to claim 1, wherein the zinc stearate particles have a number average roundness of no greater than 0.87.

4. The toner according to claim 1, wherein the zinc stearate particles have a number average roundness of at least 0.80.

5. The toner according to claim 1, wherein the toner particles each further include an external additive attached to a surface of the toner mother particle.

6. The toner according to claim 1, wherein the presence ratio of the zinc stearate particles having a particle diameter of no greater than 1.0 μm is at least 0.1% by volume relative to the total amount of the zinc stearate particles, and the presence ratio of the zinc stearate particles having a particle diameter of at least 10.0 μm is at least 0.1% by volume relative to the total amount of the zinc stearate particles.

* * * * *